United States Patent [19]

Mölle

[11] Patent Number: 4,675,000

[45] Date of Patent: Jun. 23, 1987

[54] PRESS

[76] Inventor: Werner H. Mölle, Ludwig Clemensstrasse 38, 6102 Pfungstadt, Fed. Rep. of Germany

[21] Appl. No.: 757,950

[22] Filed: Jul. 23, 1985

[30] Foreign Application Priority Data

Jul. 24, 1984 [DE] Fed. Rep. of Germany ... 8422028[U]

[51] Int. Cl.[4] ..... B05B 1/14

[52] U.S. Cl. ..... 493/372; 83/563; 83/697

[58] Field of Search ..... 493/61, 340, 355, 372, 493/396; 72/319, 389, 446; 83/563, 632, 697

[56] References Cited

U.S. PATENT DOCUMENTS

| | | | |
|---|---|---|---|
| 601,774 | 4/1898 | Fowler | 72/320 |
| 1,143,672 | 6/1915 | Weiss et al. | 493/372 |
| 1,709,564 | 4/1929 | Pamphilis | 493/372 |
| 3,845,655 | 11/1974 | Krieg | 72/389 |
| 4,491,004 | 1/1985 | Ivanoff | 72/389 |

FOREIGN PATENT DOCUMENTS

| | | | |
|---|---|---|---|
| 1002138 | 8/1965 | United Kingdom | 72/389 |
| 1352677 | 5/1974 | United Kingdom | 83/697 |

*Primary Examiner*—Frederick R. Schmidt
*Assistant Examiner*—Robert Showalter
*Attorney, Agent, or Firm*—Burns, Doane, Swecker & Mathis

[57] ABSTRACT

The press, which is suitable for creasing, scoring, perforating or cutting of board or similar material, comprises two upright spaced-apart frame members, which are interconnected by a transverse member and each of which is provided with a vertical guide, a horizontal press beam, which is mounted in the vertical guides and is connected with a crank, and a pressure beam, which is fixed on the frame members and is parallel to the press beam. The crank is fixed on one of the frame members and has an actuating arrangement. A work table is provided on the pressure beam. A bearing surface, which is vertical in the pressing position and changes at its upper end into a horizontal projecting pressure surface, is provided at the bottom end of the press beam at which are also fixed spaced-apart resilient holders.

10 Claims, 7 Drawing Figures

Fig. 3
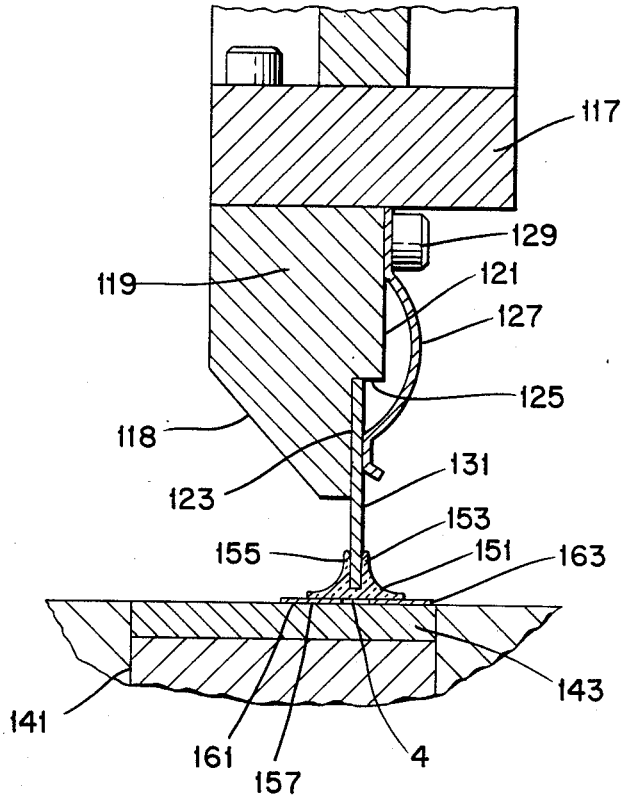
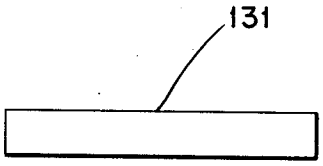
Fig. 4

PRESS

FIELD OF INVENTION

The invention relates to presses for creasing, scoring, perforating or cutting board of similar material generally, and more particularly to such presses having arrangements which facilitate retooling.

BACKGROUND OF THE INVENTION

In the manufacture of foldable cartons, e.g. for the packaging of goods, the blank of the carton must be provided with crease lines, scoring or even perforation so that the treated carton can be erected by folding to form the desired container and then glued.

There are suitable machines for mass production of packaging containers, each of which have, however, the disadvantage that in order to be reset for differently sized packaging they must be retooled. In view of the large quantities of packaging which can be produced with such machines, the relatively long time needed for retooling can be tolerated.

In the manufacture of special packaging and samples by a sample maker, e.g. for the presentation of goods, only small number of packaging are needed. Accordingly, the time needed for retooling of the machine becomes very significant.

OBJECTS AND SUMMARY OF THE INVENTION

The aim of the invention is to provide a press for creasing, scoring, perforating or cutting board, carton or similar material for sample makers, which can be quickly and easily reset for any kind of material needed to be used.

The invention provides a press for creasing, scoring, perforating or cutting board or similar material comprising two upright spaced-apart frame members, which are interconnected by a transverse member and each of which is provided with a vertical guide, a horizontal press beam, which is mounted in the vertical guides and is connected with a crank, and a pressure beam, which is fixed on the frame members and is parallel to the press beam, the crank being fixed on one of the frame members and being provided with actuating means, a work table being provided on the pressure beam, wherein a bearing surface, which is vertical in the pressing position and changes at its upper end into a horizontal projecting pressure surface, is provided, and spaced-apart resilient holders are fixed, at the bottom end of the press beam. This arrangement enables clamping of flat or wavy tools for creasing, scoring perforating or cutting between the holders and the bearing surface, which may be, as necessary, replaced by other tools of different shape. As a consequence the retooling of the press is fast and allows reproducible adjustment of the tools without the need to release the holders.

In a preferred embodiment of the invention the time needed for retooling is shortened further in that a counter-pressure member is detachably situated on the pressure beam so that templates glued on to the counter-pressure member may be removed outside the press while the press is available for other work with a new counter-pressure member.

In order to improve the necessary bending stiffness of the press beam, another preferred embodiment of the invention fixes on the bottom end of the press beam a mounting member on which are formed the aforementioned surfaces and on which are detachably screwed the holders. Bent steel-strip springs are preferred for the holders because they exert the necessary pressure on to the tool which is being used.

A particularly advantageous embodiment of the invention is one in which the line of pressing of the press is spaced apart from the axis of the counter-pressure member. In this embodiment the counter-pressure member with the templates glued thereon may be turned and used for further pressing operation without obstruction by the strip-shaped templates situated behind the line of pressing.

The accessibility of the holders and consequently the retooling is further simplified according to the invention when the press beam is so arranged in the frame members that it is tiltable in a plane perpendicular to the line of pressing of the press. In that embodiment the press beam can be so tilted for the purpose of retooling that its bottom end with the holders is easily accessible from the front.

BRIEF DESCRIPTION OF THE DRAWING

The invention will now be described, by way of example, with reference to the accompanying diagrammatic drawings, in which:

FIG. 3 is a diagrammatic cross-section through the template;

FIG. 4 is a diagrammatic front elevation of a creasing tool;

DETAILED DESCRIPTION OF THE PREFERRED EMBODIMENTS

Figure 1:
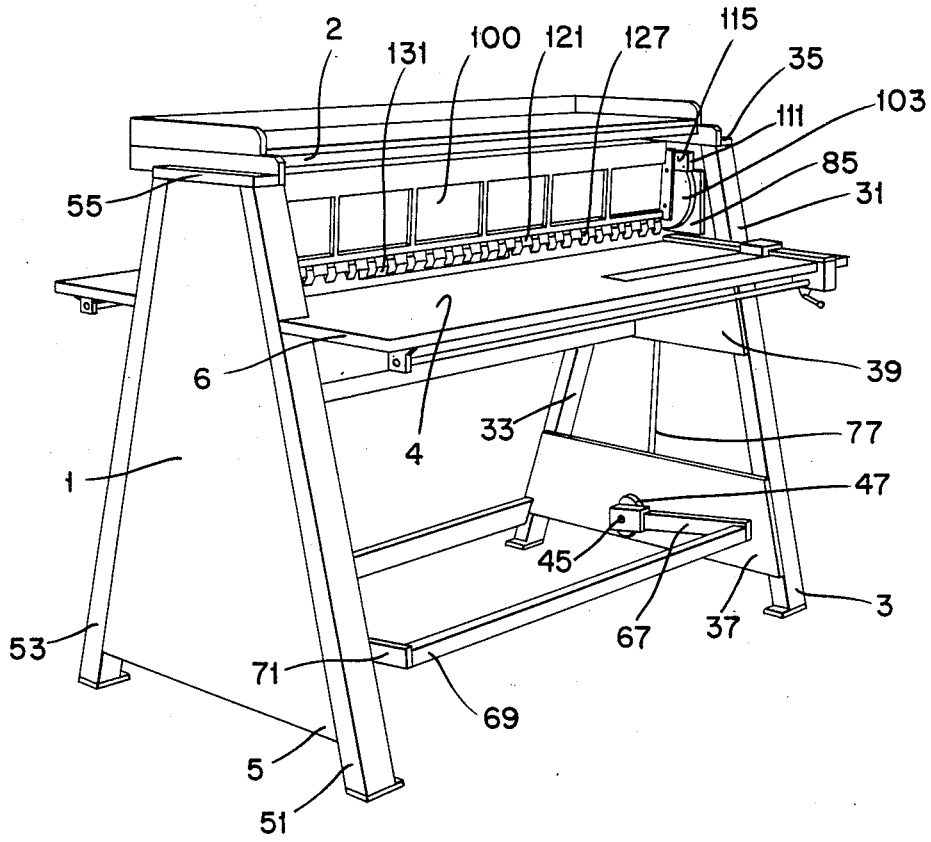
FIG. 1 is a perspective view of a press having the features of the invention.

Referring to FIG. 1 the press 1 has two lateral spaced upright frame members 3,5 which are interconnected by an upper transverse member 2 and by a plate 6, which is arranged below a horizontal working table 4 into a stiff frame. Each frame member 3,5 has in side elevation substantially the shape of an isosceles trapezium and is formed by a front leg 31,51 and a rear leg 33,53, the legs being interconnected at their upper ends by a horizontal upper plate 35,55. The legs 31,51 are on their sides facing each other connected at the inside of their U-section shape by a lower reinforcing plate 37 and an upper reinforcing plate 39. Corresponding reinforcing plates between the legs 51 and 53 are not shown.

Figure 6:
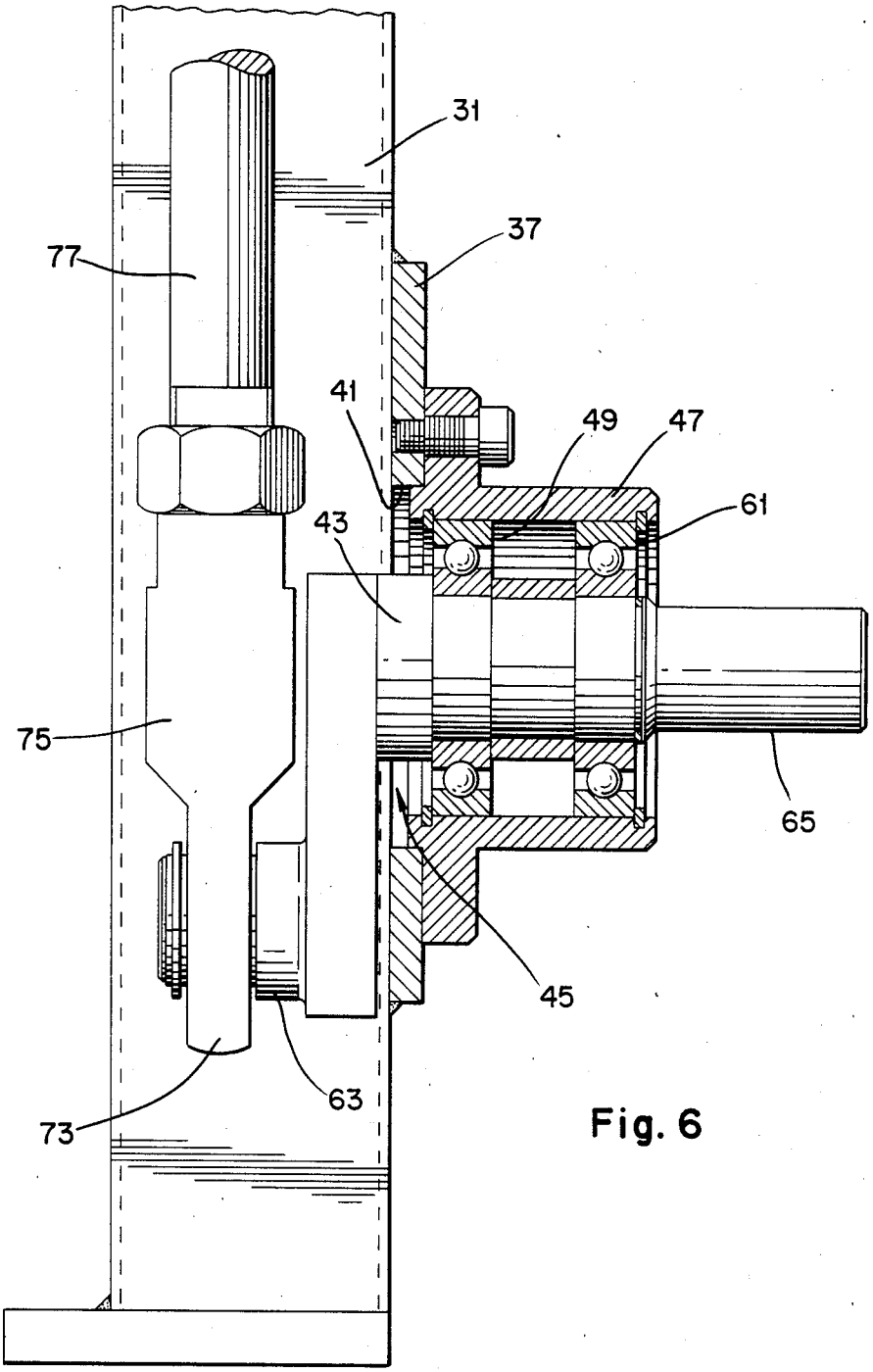
FIG. 6 is a detail of a diagrammatic longitudinal section through the crank drive for the press beam.

In the lower reinforcing plate 37 is in the middle between the legs 31,33 provided an opening 41 (FIG. 6) through which extends the shaft 43 of a crank 45. The shaft 43 is mounted in a bearing housing 47, which is fixed on the reinforcing plate 37, in two spaced-apart ball bearings 49,61.

On the free end 65 of the shaft which extends outwardly from the bearing housing 47 is nonrotatably keyed a lever 67 extending parallel to the reinforcing plate 37. Its forwardly extending end is connected to an elongate pedal 69 which extends between the legs 31,51 in the foot region.

Not shown is a corresponding crank in the lower reinforcing plate connecting the legs 51,53, the axis of which coincides with the axis of the crank 45. The pedal 69 is accordingly connected to the lever 71 which is nonrotatably connected to this crank.

On the free end of the crank pin 63 is mounted an eye 73 of a foot 75 of a connecting rod 77 which extends upwardly within the frame member 3.

Figure 7:
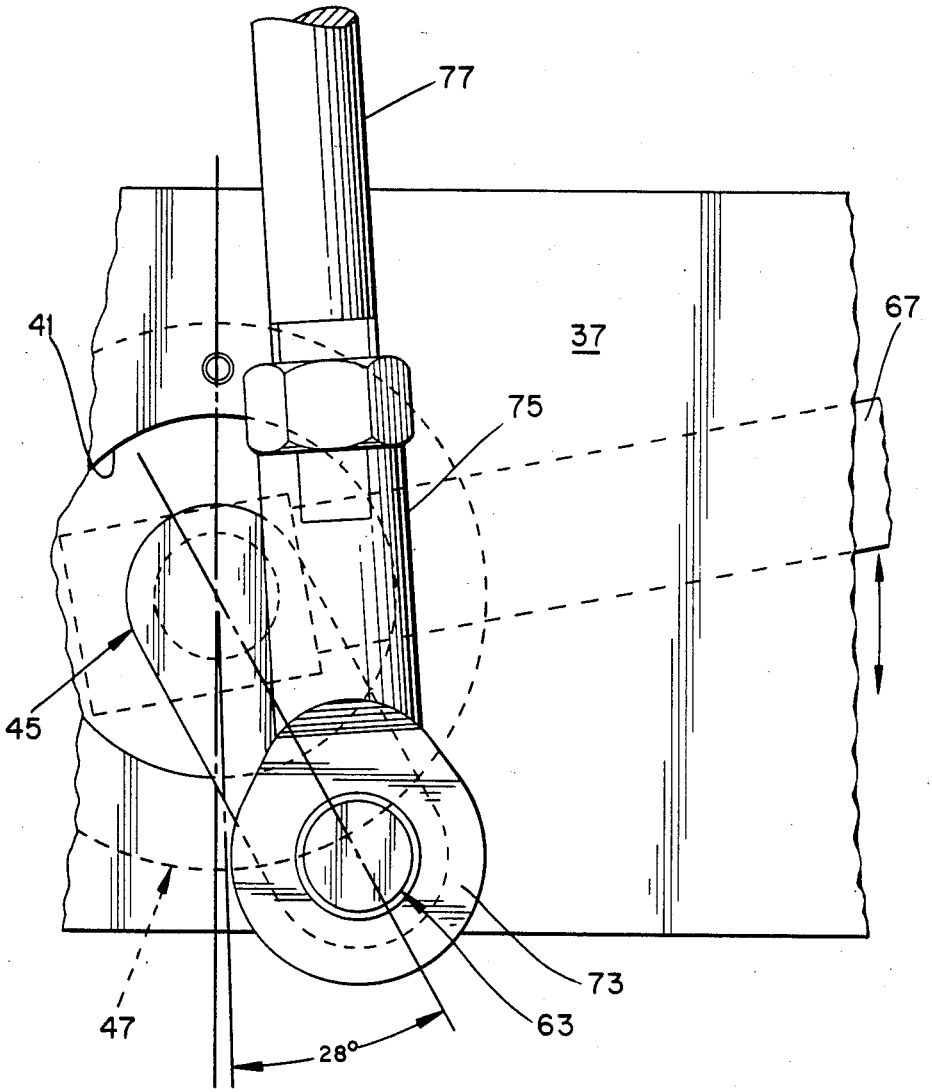
FIG. 7 is a diagrammatic representation of the operation of the crank drive.

According to FIG. 7 the levers 67 and 71 are mounted on the shaft 65 of the crank 45 in such a way that the crank pin 63 may be rotated against the restoring force of the press from an angle of about 30° to an angle of about 2° with respect to the vertical axis extending through the bottom dead centre of the crank pin 63. Due to this arrangement a pressing force of about 5 t can be obtained with a step-on-force of about 30 kp. Not illustrated is a mechanical stop which prevents further rotation of the crank pin 63 beyond its bottom dead center.

Figure 2:
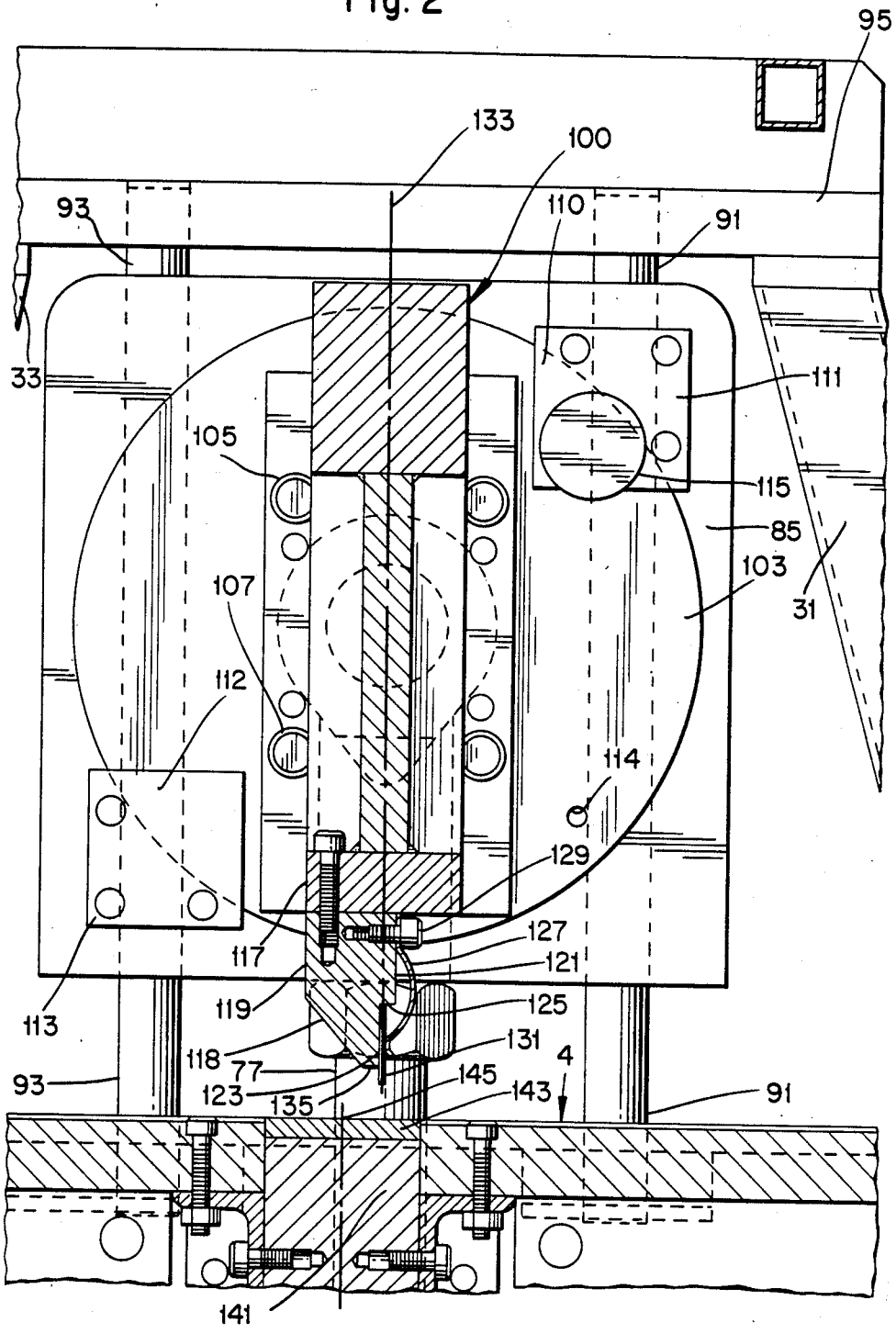
FIG. 2 is a diagrammatic representation of a vertical section through the press beam with the counter-pressure member.
Figure 5:
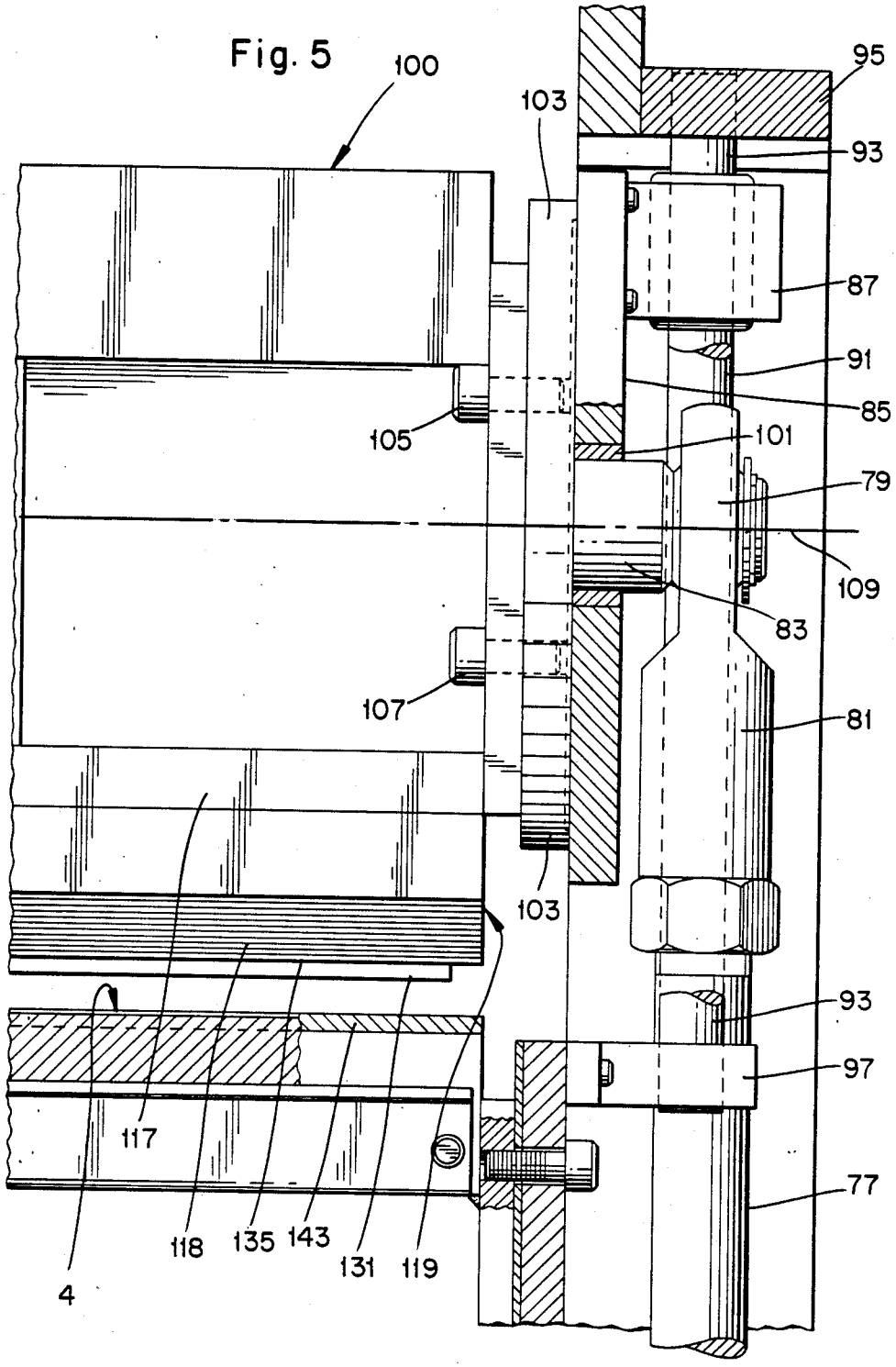
FIG. 5 is a detail from a diagrammatic longitudinal section through the lateral suspension of the press beam.

In the eye 79 of the head 81 of the connecting rod 77 (FIG. 5) is rotatably mounted a pin 83 of a guide plate 85 which is guided to be freely displaceable by two pairs of arrangements, each comprising two aligned plain bearings 87, in two vertical guide columns 91,93, As is apparent particularly from FIG. 2, the guide columns 91,93 extend parallel to each other at the same distance from the line of pressing and are firmly anchored in an upper plate 95 and in a lower plate 97. Each of the guide columns 91,93 is surrounded by two vertical spaced-apart plain bearings, each of which is screwed to the guide plate 85 and of which only the plain bearing 87 is illustrated in FIG. 5.

The arrangement is such that when pressure is exerted on the pedal 69, e.g. by a foot from above, the crank 45 is turned in such a way that the crank pin 63, as shown in FIG. 7, moves downwardly and as a consequence the guide plate 85 is moved by the connecting rod correspondingly vertically downward, parallel to the guide columns 91,93.

The guide plate 85 is, by an intermediate plate 103, mounted by bolts 105,107 a press beam 100 nondisplaceably but rotatably about the axis 109 of the pin 83. The intermediate plate 103 extends with the central pin 83, which projects from it on the side remote from the press beam 100, through a bush 101, which is fitted in a hole in the guide plate, through the guide plate 85, and as a consequence follows on the one hand its movement to and from and on the other hand is mounted in the bush 101 tiltably about the axis 109. Onto the side of the guide plate 85 facing the press beam 100 are immediately next to the round intermediate plate 103 screwed diametrically opposite to each other two clips 111,113 each of which overlap the intermediate plate 103 by a section 110,112 of reduced thickness.

According to FIG. 2, when viewing the press from the front side, the upper clip 111 is mounted on the guide plate 85 before the press beam 100 and the other clip 113 behind and below the press beam 100. The intermediate plate 103 has in the region of the upper clip 111 a blind hole 114 (not shown) into which may engage the head of a retention pin which is biased by a spring and ends outwardly in a handle 115. When the retention pin engages into said blind hole this defines the vertical position of the press beam 100; if the retention pin is withdrawn from the blind hole by the handle 115, the press beam 100 with the intermediate plate 103 may be moved about the axis 109 in the representation shown in FIG. 2 anticlockwise until the retention pin enters another blind hole 114 which is displaced through 90°.

The press beam 100 has the shape of a welded double T section which bridges the whole working width of the press 1 and has a bottom flange 117. On a mounting member 119 are formed two vertical planar and from the working side accessible surfaces, namely an upper mounting surface 121 and a lower bearing surface 123, of which the bearing surface 123 is set rearwardly relative to the mounting surface 121 and forms thereby a horizontal pressure surface 125. The mounting surface 121, the bearing surface 123 and the pressure surface 125 extend over the whole width of the press beam 100 and below it. As is apparent from FIGS. 1 and 2 forwardly arched steel-strip springs 127 are detachably mounted by screws 129 on the mounting surface 121, the springs being provided to press at least one tool 131 against the bearing surface 123. As is apparent from FIG. 1 the tool 131 need not occupy the whole width of the press. As a consequence several tools 131 can be mounted next to each other on the mounting member 119 by means of the springs 127. The position of the pressure surface 125 is so chosen that its central plane 133, extending through the length of the press beam 100, extends through the centre of the tool (FIG. 2) and at its intersection with the working table 4 defines the line of pressing. It will be further understood that the pressure surface 125 is spaced from the bottom end 135 of the mounting member 119 through a distance which is smaller than the vertical length of the tool 131, so that the latter projects downwardly beyond the mounting member 119. The mounting member 119 is at its rear bottom part provided with a forwardly extending inclined portion 118. The working table 4 has in the region below the press beam 100 a press table 141 firmly connected to the frame members 3,4, the table taking up the pressing pressure generated by the tool. The press table 141 is so sunk relative to the press beam 100 that a recess is formed which extends along the whole width of the press and has the shape of a right angle in cross-section. In this recess is situated a counter-pressure plate 143 which can be easily removed from the recess. As is apparent from FIG. 2, the counter-pressure plate 143 has an axis 145 which extends parallel to the central plane 133 and which is displaced relative to the central plane 133 backwards.

In order to form creases in packaging cartons, tools are used the bottom end of which can extend rectilinearly. For perforation the bottom end of the tool is serated according to the desired perforation. For the formation of cuts, the bottom end of the tool is provided with an edge which penetrates the carton.

A template 151, such as the one shown in cross-section in FIG. 3, is used for such work. The template 151 comprises an elongate strip of plastic the length of which corresponds to the length of the desired action onto the carton. The template 151 has a wide foot 157 above which are situated two spaced-apart mutually parallel tongues 153,155. The distance between the tongues 153,155 corresponds to the thickness of the tool 131. In the bottom of the wide foot 157 are glued two mutually parallel strips of board 161,163, which are adhesive on both sides and which define between themselves a counter-groove corresponding to the crease or perforation to be made in the packaging carton.

For the tooling of the press a tool 131 suitable for the desired operation is first clamped under the springs 127 such that it bears onto the bearing surface 123 and the pressure surface 125 and the screws 129 for the clamping of the springs 127 are tightened. Then the template 151 is slipped onto the free edge of the tool 131 and the press is by pressure onto the pedal 69 so actuated that the template 151 with the strips 161,163 is pressed onto the counter-pressure plate 143. In the return movement of the press the tool 131 is withdrawn from the space between the tongues 153,155 so that the plastics member 151 may be removed from the strips 161,163 which remain stuck on the counter-pressure plate 143. The press can then be used for making e.g. a crease in a packaging carton (not shown) which is inserted into the press into contact with a stop (not shown). If further creases or preforations are to be made in the packaging cartons for which another template 151 is needed, the counter-pressure plate 134 is removed from the recess in the press table 141 and is moved about its upper axis so that the stuck-on strips 161,163 are now behind the line of pressing. In this way a free space is obtained on the counter-pressure plate 143 for the application of another template.

For retooling of the press, i.e. for the fixing of another tool, the retention pin of the intermediate plate 103 is released by the handle 115 and the press beam 100 is tilted through about 90° forwards so that the screws 129 are easily accessible from the front and the tool may be removed and another tool put in its place.

One of the advantages of the invention is that springs 127 need not be released for the exchange of tools. The introduction of a new tool is simplified when the springs 127, as shown on the bottom end 128, are bent outwardly. A special advantage of the invention is that not only planar but also wavy tools or tools bent into a loop may be clamped on the assembly rail 119. Such tools may in clamped state slightly exceed the depth of the pressure surface 125 as long as the press force of up to 5 t is safey transmitted onto the tool. The press can therefore be used also for the cutting of holes in board.

So far as the accompanying drawings show features needed for the understanding of the invention, which have not been specifically mentioned or have not been sufficiently described, these features are to be considered as being features of the claimed invention. So, for instance, the mounting of the press beam 100 was described on only one of the frame members 3,5; a mirror-symetrical mounting of the press beam 100 is also provided for in the other frame member. It is not mentioned that the press beam 100 may be held by suitable elastic means in the upper dead centre of its stroke. This means may, for instance, be carried out in practice such that springs are provided between the bottom plate 97, in which are anchored the guide columns 91,93, and the respective bottom plain bearing. In addition the bottom plate 97 can have means for the limitation of the downward movement of the press beam 100 which prevent the tool 131 from penetrating too deeply into the packaging carton between the strips 161,163 stuck on the counter-pressure plate 143. This limitation of the downward movement can be height-adjustable.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. Press for creasing, scoring, perforating or cutting board or similar material comprising two upright spaced-apart frame members which are interconnected by a transverse member, a horizontal press table fixed on the frame members, a fixed vertical guide and a crank mounted to each frame member, each crank having actuating means and being pivotably connected to one of two opposite ends of a horizontal press beam, the press beam being mounted to the vertical guide so as to be movable vertically along the guide in a vertical plane substantially normal to said horizontal press table, means for selectively rotating the press beam from a pressing position in said vertical plane to a retooling position in a horizontal plane, the press beam being provided with a tool bearing surface and with a pressure surface adjoining the bearing surface, said tool bearing surface and said pressure surface fixed relative to said press beam, the tool bearing surface being vertical in the pressing position and the pressure surface being horizontal in the pressing position, the bottom end of the press beam being provided with spaced-apart resilient tool holders, the press table having a counter-pressure member located therein, the press beam being fixed on a guide plate, said selectively rotating means rotating said press beam relative to said guide plate about an axis parallel to the line of pressing, the guide plate being mounted to the vertical guide so as to be movable vertically by the crank.

2. The press according to claim 1 wherein a mounting member is fixed to the bottom end of the press beam on which are formed the bearing surface and the pressure surface and on which the holders are detachably screwed.

3. The press according to claim 1 wherein the holders are steel-strip springs.

4. The press according to claim 1 wherein the counter-pressure member is detachably located within the press table, and wherein the axis of the counter-pressure member is spaced-apart from the line of pressing of the press.

5. The press according to claim 2 wherein the counter-pressure member is detachably located within the press table, and wherein the axis of the counter-pressure member is spaced-apart from the line of pressing of the press.

6. The press according to claim 1 wherein the crank includes a crank pin which is rotatable, by a pedal mounted on the crank, only within the angular vicinity ahead of the bottom dead center of its vertical movement.

7. The press according to claim 2 wherein the crank includes a crank pin which is rotatable, by a pedal mounted on the crank, only within the angular vicinity ahead of the bottom dead center of its vertical movement.

8. The press according to claim 4 wherein the crank includes a crank pin which is rotatable, by a pedal mounted on the crank, only within the angular vicinity ahead of the bottom dead center of its vertical movement.

9. The press according to claim 5 wherein the crank includes a crank pin which is rotatable, by a pedal mounted on the crank, only within the angular vicinity ahead of the bottom dead center of its vertical movement.

10. The press according to claim 1, wherein said rotating means includes a member intermediate of said press beam and said guide plate, said intermediate member journaled with said guide plate.

* * * * *